US006631700B2

(12) United States Patent
Diggs et al.

(10) Patent No.: US 6,631,700 B2
(45) Date of Patent: Oct. 14, 2003

(54) DUAL OIL FEED VARIABLE TIMED CAMSHAFT ARRANGEMENT

(75) Inventors: Matthew Byrne Diggs, Farmington, MI (US); Michael George Aimone, Belleville, MI (US); Hoa T. Dinh, Shelby Township, MI (US); Eduard Golovatai-Schmidt, Rottenbach (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 09/742,707

(22) Filed: Dec. 20, 2000

(65) Prior Publication Data

US 2003/0062010 A1 Apr. 3, 2003

(51) Int. Cl.[7] ..... F01L 1/34

(52) U.S. Cl. ..... 123/90.17; 123/90.15; 123/90.16

(58) Field of Search ..... 123/90.15, 90.16, 123/90.17, 90.18

(56) References Cited

U.S. PATENT DOCUMENTS

| | | | | |
|---|---|---|---|---|
| 4,858,572 A | * | 8/1989 | Shirai et al. | 123/90.12 |
| 5,107,804 A | | 4/1992 | Becker et al. | 123/90.17 |
| 5,113,814 A | * | 5/1992 | Suga et al. | 123/90.17 |
| 5,184,581 A | * | 2/1993 | Aoyama et al. | 123/90.31 |
| 5,205,249 A | | 4/1993 | Markley et al. | 123/90.17 |
| 5,275,138 A | * | 1/1994 | Hotta et al. | 123/90.17 |
| 5,301,639 A | * | 4/1994 | Satou | 123/90.17 |
| 5,361,735 A | | 11/1994 | Butterfield et al. | 123/90.17 |
| 5,367,992 A | | 11/1994 | Butterfield et al. | 123/90.17 |
| 5,507,254 A | | 4/1996 | Melchior | 123/90.17 |
| 5,540,197 A | * | 7/1996 | Golovatai-Schmidt et al. | 123/90.17 |
| 5,622,144 A | * | 4/1997 | Nakamura et al. | 123/90.15 |
| 5,657,725 A | | 8/1997 | Butterfield et al. | 123/90.17 |
| 5,809,955 A | * | 9/1998 | Murata et al. | 123/90.17 |
| 5,826,552 A | | 10/1998 | Noguchi et al. | 123/90.17 |
| 5,829,399 A | * | 11/1998 | Scheidt et al. | 123/90.17 |
| 5,836,275 A | * | 11/1998 | Sato | 123/90.17 |
| 6,135,077 A | | 10/2000 | Moriya et al. | 123/90.17 |
| 6,382,148 B1 | * | 5/2002 | Maeyama et al. | 123/90.15 |

* cited by examiner

*Primary Examiner*—Thomas Denion
*Assistant Examiner*—Ching Chang
(74) *Attorney, Agent, or Firm*—Dykema, Gossett; Carlos Hanze

(57) ABSTRACT

An arrangement 7 of a dual oil feed variable timed camshaft is provided. The arrangement includes a camshaft 10 which has a radial side 22 and an end face 26. The camshaft 10 has first and second passages 30, 42 fluidly connecting end face 26 with the radial side 22. A hub 60 is connected with camshaft end face 26. The hub 60 has a central opening 68 intersecting with the first and second passages 30, 42. The hub 60 has at least first and second axial spaced radial passages 80, 82 intersecting with the hub central opening 68. A timing pulley 90 has relative rotational movement with respect to the hub 60. The timing pulley 90 and the hub 60 define pressure chambers 104 which are divided by vanes 88 into retard angle spaces 108 intersecting with the hub first radial passages 80 and advance angle spaces 112 intersecting with the hub second radial passage 82. A fastener 121 is provided having intersecting longitudinal and radial bores 140, 142 fluidly connecting the camshaft first passage 30 with the hub first radial passage 80. The fastener 121 connects the hub 60 to fasten the hub with the camshaft 10.

23 Claims, 2 Drawing Sheets

DUAL OIL FEED VARIABLE TIMED CAMSHAFT ARRANGEMENT

FIELD OF THE INVENTION

The field of the present invention is that of an arrangement of a variable timed camshaft for an automotive internal combustion engine. More particularly, the present invention relates to an arrangement of an advance and retard pressurized fluid supply variable timed camshaft having for an automotive internal combustion engine.

BACKGROUND OF THE INVENTION

Automotive vehicle engines with reciprocal pistons typically have a plurality of cylinder combustion chambers with the reciprocating pistons mounted therein. Each piston is pivotally connected with a piston rod, which is pivotally connected with a crankshaft. At an end of the crankshaft a timing gear is mounted. Typically, each cylinder has at least one intake valve and one exhaust valve. Both the intake valve and the exhaust valve are spring loaded to a closed position. Each intake and exhaust valve is associated with a rocker arm. To operate the valves, the rocker arms are moved by a set of contacting cam lobes. The cam lobes are mounted on an elongated member known as a camshaft. Attached at an extreme end of the camshaft is a camshaft pulley. The camshaft pulley is powered by the crankshaft via a timing chain or belt which is looped over the camshaft pulley and the crankshaft timing gear. Accordingly, the camshaft is synchronized with the crankshaft and the timing of the opening and closing of the intake and exhaust valves is fixed with respect to the position of the piston within the cylinder combustion chamber.

In an effort to improve the environment by decreasing polluting emissions and increasing vehicle gas mileage, it has become desirable to allow the timing of the cylinder valve operation to vary with respect to the piston position within the cylinder chamber. To provide for the variable valve timing operation, variable cam timing units (VCT) are provided on the camshaft. A dual oil feed vane-type variable cam timing unit provides an inner member or hub that is fixably connected to an end face of a camshaft. The hub has a series of vanes which are captured in cavities or pressure chambers provided in an outer member which is concentrically mounted on the hub. The outer member incorporates the camshaft timing pulley. The vanes circumferentially bifurcate the pressure chambers into an advance side and a retard side. A spool valve, fluidly communicative with the pressure chambers via the inner member and the camshaft, controls the fluid pressure in the advance side and retard side of the pressure chambers. Accordingly, the angular position of the timing pulley versus the crankshaft can be varied by controlling the fluid in the advance and retard pressure chambers.

In the prior art, the hub was connected by abutting contact to an end face of the camshaft by a threaded fastener. Typically, a set of retard pressurized fluid longitudinal bores were drilled into the end face of the camshaft. The hub had a set of retard pressurized fluid longitudinal bores aligned with the retard bores of the camshaft to allow fluid flow between the interface of the hub and the camshaft end face. The retard longitudinal bores of the camshaft, away from the camshaft end face (camshaft forward end), were intersected by radial cross-bores. The retard radial cross-bores fluidly communicated with an annular groove on the camshaft. The encircling groove on the camshaft fluidly communicated with the aforementioned spool valve which controls the fluid pressure in the advance and retard side in the pressure chambers between the hub and the timing pulley. In a similar manner to that described, there were additionally two longitudinal bores for the advance pressurized fluid. If the annular groove for the advance pressurized fluid was closer to the camshaft end face than the retard annular groove, the advance cross-bores were omitted and the advance longitudinal bores directly intersected with their respective annular groove. The longitudinal bores of the camshaft for the advance pressurized fluid also were aligned with longitudinal bores in the hub so that advance pressurized fluid could pass through the interface between the hub and the camshaft end face. When the hub was tightened by the fastener against the camshaft, the aforementioned retard and advance longitudinal bores in the camshaft had to be sealed with their respective bores within the hub. The sealing interface between the hub and the camshaft end face was dependent upon the machining and alignment between the hub and the camshaft. Accordingly, the sealing interface or clamping zone was not always predictable. Additionally, a required clamping load between the hub and the camshaft was dependent upon the sealing interface and therefore was not predictable.

Another disadvantage in the prior art was that there were four longitudinal bores extending between the camshaft end face and the hub. The two longest longitudinal bores had to be drilled past the annular groove nearest the camshaft end face. Accordingly, they had to be radially nearer the axial centerline of the camshaft than the other set of longitudinal bores. Additionally, there was a central or axial threaded bore to allow the fastener to be threadably connected with the camshaft. The presence of five axial bores drilled within the camshaft brought about a minimum required camshaft diameter which further defined the minimum journal bearing diameter allowed for a given camshaft.

U.S. Pat. No. 6,135,077, Moriya et al., provides a dual oil feed helical-type variable timing camshaft arrangement. In FIG. 2, one of the oil feeds passes through a fastener which attaches a hub member to the camshaft. Therefore, one of the pressurized fluid flows can pass through the axial centerline of the camshaft and the camshaft general bearing diameter can be minimized. However, the VCT unit of Moriya, et al. requires a sealing cap.

It is desirable to provide an arrangement of a VCT in which a journal bearing diameter of the camshaft can be held to a minimum value without the use of a sealing cap. It is desirable to provide a VCT arrangement wherein the clamping load between the inner member(hub)and camshaft is predictable and allowed to be along an annular ring on the face of the camshaft adjacent the camshaft outer diameter. Such an arrangement will provide the largest holding torque between the camshaft and VCT.

SUMMARY OF THE INVENTION

To make manifest the above delineated and other desires, the revelation of the present invention is brought forth. In a preferred embodiment, the present invention provides an arrangement of an advance and retard or dual oil feed variable timed camshaft for an automotive vehicle internal combustion engine. The arrangement includes a camshaft that has a radial side and an extreme longitudinal end face. The camshaft has a first passage fluidly connecting the camshaft end face with the radial side of the camshaft away from the end face. The first passage includes a longitudinal axial bore with a threaded portion.

The camshaft also has a second passage fluidly separated from the first passage connecting the camshaft end face with a radial side of the camshaft away from the end face. A hub is provided for abutting connection with the camshaft end face. The hub has a central opening intersecting with the first and second passages of the camshaft. The hub has at least first and second radial passages intersecting with the hub central opening. The hub first and second radial passages are axially spaced from one another. A timing pulley assembly is mounted on the hub having relative rotational movement with respect to the hub. At least one vane is connected to either the timing pulley assembly or to the hub. The timing pulley assembly and the hub define a pressure chamber therebetween which is divided into an advance angle space intersecting with the hub first radial passage and a second retard angle space intersecting with the hub second radial passage. A fastener is provided having a head and a threaded shank extending therefrom. The fastener shank has intersecting longitudinal and radial bores fluidly connecting the camshaft first passage with the hub first radial passage. The fastener head contacts with the hub to fasten the hub with the camshaft. A sealing member provides an interface between the shank of the fastener and the hub central opening to separate portions of the hub central opening exposed to the hub first radial passage from portions of the hub central opening exposed to the hub second radial passage.

It is an advantage of the present invention to provide an arrangement of a dual oil feed variable timed camshaft wherein a bolt fastener, which attaches an inner member or hub to the camshaft, also provides a fluid communicative path which extends radially outwardly.

It is also an advantage of the present invention to provide an arrangement of a dual oil feed variable timed camshaft wherein a single unitary fastener connects a hub with the camshaft and also wherein the fastener axially loads a sealing member which separates the advance and retard fluid paths.

It is also an advantage of the present invention to provide an arrangement of a dual oil feed variable timed camshaft, wherein the clamp zone between the hub and the end face of the camshaft is along a ring on the face of the camshaft adjacent the camshaft outer diameter providing the largest holding torque between the camshaft and hub and also providing a predictable clamping load.

The above-noted and other advantages of the present invention will become more apparent to those skilled in the art from a review of the invention as is provided in the accompanying drawings and detailed description.

DETAILED DESCRIPTION OF THE DRAWINGS

Figure 1:
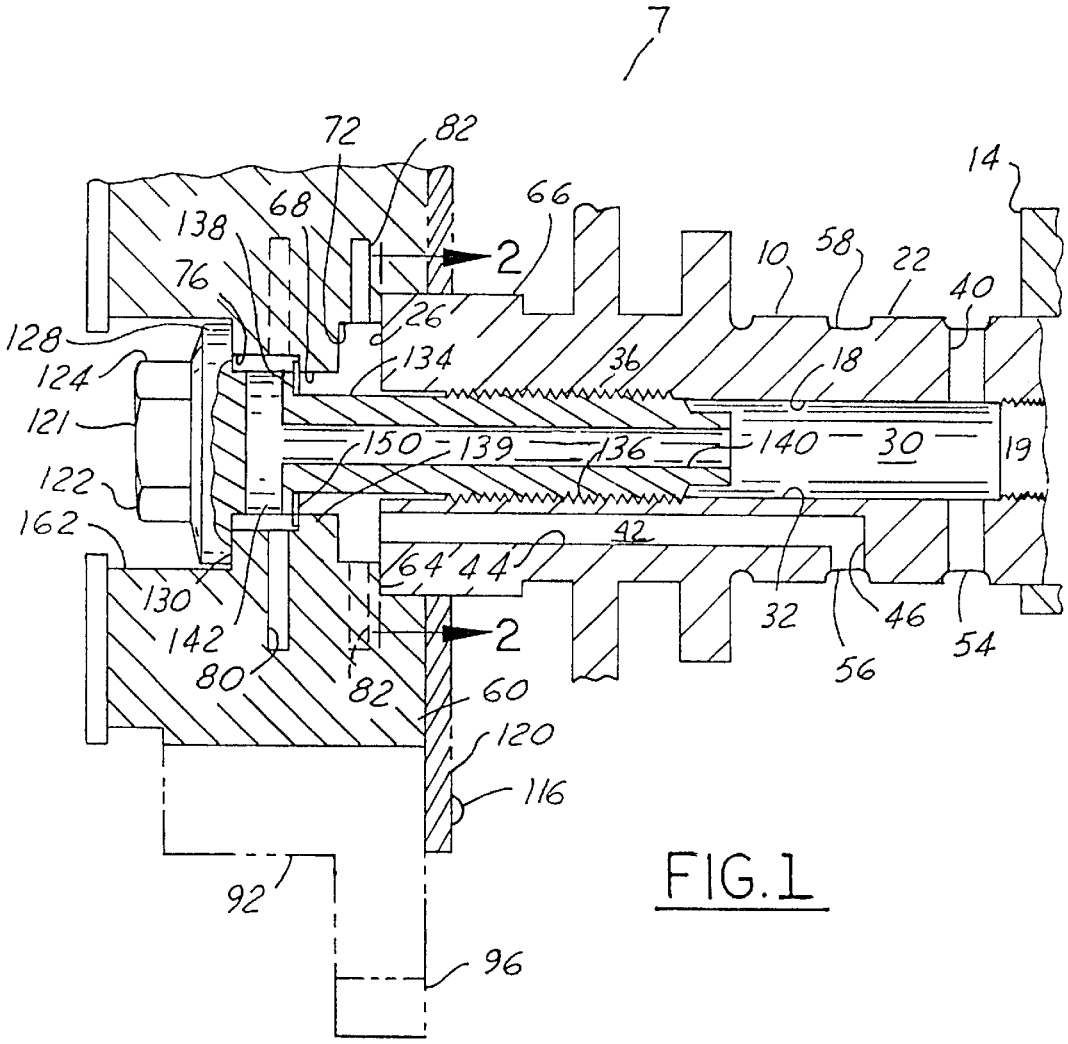
FIG. 1 is a sectional view of a preferred embodiment camshaft arrangement according to the present invention.
Figure 2:
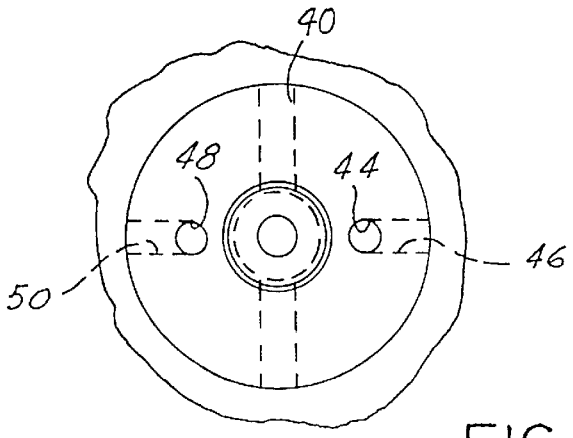
FIG. 2 is a view taken along lines 2—2 of FIG. 1.

Referring to FIGS. 1–2, an arrangement 7 of a dual oil feed vane-type variable timed camshaft for an automotive vehicle internal combustion engine is provided having a camshaft 10. The camshaft 10 has a series of lobes 14 that are weldably connected thereon. In the example shown, the camshaft 10 is fabricated from an elongated tubular member having an inner diameter 18. The inner diameter 18 is closed by a plug 19.

The camshaft 10 has a radial side 22. The camshaft 10 also has an extreme longitudinal end face 26. The camshaft has a first fluid passage 30. The first fluid passage 30 fluidly connects the camshaft end face 26 with the radial side 22. The camshaft first passage 30 includes a longitudinal bore 32 which may be provided by the camshaft inner diameter 18 or alternatively may be a finished machine bore. The camshaft longitudinal bore 32 has a threaded portion 36. The camshaft first passage 30 also includes a radial through bore 40 which intersects with the longitudinal axial bore 32. The radial through bore 40 intersects with an annular groove opening 54.

The camshaft also has a second fluid passage 42 which is fluidly separated from the first fluid passage 30. The second fluid passage 42 fluidly connects the end face 26 with the camshaft radial side 22 at annular groove opening 56 in a location spaced away from the end face 26. The second fluid passage 42 includes a generally longitudinal non-axial bore 44 which intersects with a generally radial bore 46. (In FIG. 1, radial bores 40, 46 are shown in the same plane for illustration, however, the actual relationship is shown in FIG. 2.) The second fluid passage 42 has a first branch provided by longitudinal bore 44 and a second branch provided by longitudinal bore 48 (shown only in FIG. 2). Longitudinal bore 48 intersects with a radial bore 50. Annular groove openings 54 of the radial bore 40 are axially spaced away from annular groove openings 56, 58 of radial bores 46, 50, respectively.

The arrangement 7 of the dual oil feed vane-type variable timed camshaft 10 has an inner member or hub 60. The hub 60 has a recessed perpendicular shoulder end face 64 for controlled abutting annular contact with end face 26 adjacent an outer diameter 66 of camshaft 10. The hub 60 also has a multi-diameter central axial opening 68. The central opening 68 has an enlarged diameter section 72 which intersects with the camshaft first fluid passage 30 and second fluid passage 42. Along its forward end, the central opening 68 has another enlarged portion 76 which intersects with a set of semi-angular, geometrically-spaced first radial passages 80. A set of semi-angular, geometrically-spaced second radial passages 82 intersect with the enlarged diameter section 72 of hub central opening 68. The first radial passages 80 are axially spaced away from the second radial passages 82.

Figure 3:
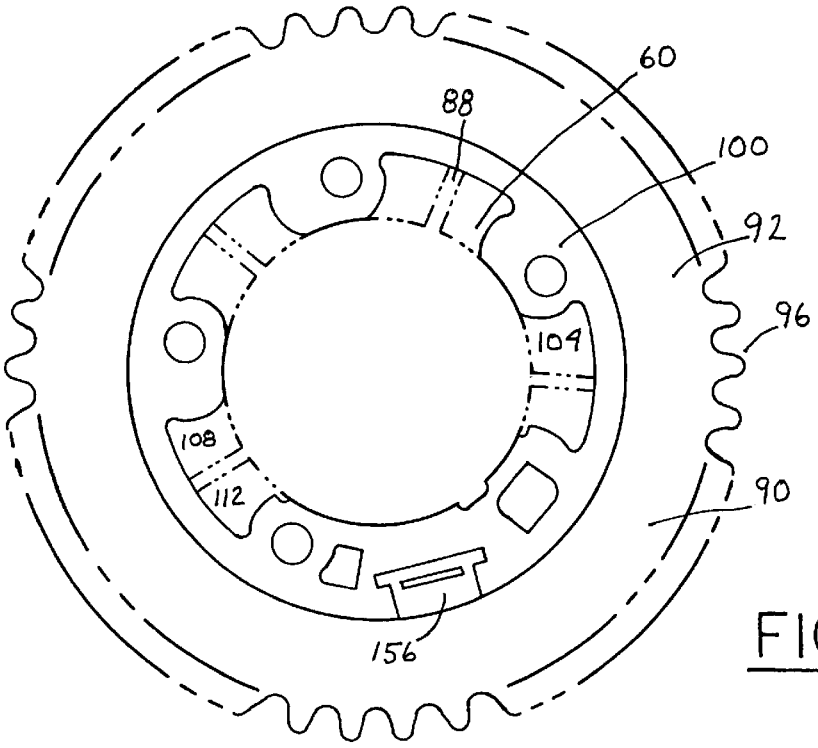
FIG. 3 is a front elevational view of a timing pulley assembly mounted on the hub shown in FIG. 1.
Figure 4:
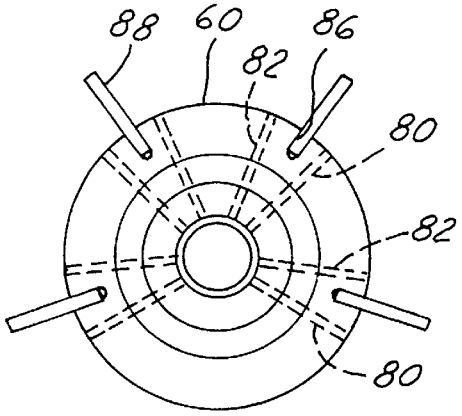
FIG. 4 is a front elevational view of the hub shown in FIG. 1 with the attached vanes which bifurcate a defined pressure chamber into an advance angle space and a retard angle space.

Referring additionally to FIGS. 3 and 4, hub 60 along its outer peripheral edge has a series of radial longitudinal slots 86. Fitted within each radial longitudinal slot 86, is a movable pressure boundary supplied by a vane 88. In FIG. 3, hub 60 and projecting vanes 88 are shown in phantom. In other embodiments (not shown), the vanes may be connected to the hub with or without the use of slots. Mounted for limited rotational movement with respect to the hub 60, is an outer member 92 which contains timing pulley assembly 90. Main outer member 92 has sprocketed teeth 96 for engagement with a timing chain (not shown) or in the case of some small four-cylinder engines, a sprocketed timing belt. The timing chain engages with a timing gear (not shown) connected with the end of a crankshaft (not shown) and transfers torsional force from the timing gear to the pulley assembly 90. The pulley assembly 90 has a series of radially inward projecting dividers 100 which define the pressure chambers 104 (FIG. 3). The pressure chambers 104 are circumferentially bifurcated into a retard directional angle space 108 and an advance directional angle space 112 by the vanes 88. The main outer member 92 is connected with a rear plate 120 and a forward plate (not shown) by a series of bolts 116 (only one shown in FIG. 1).

Referring to FIG. 1, the arrangement 7 of a vane-type variable timed camshaft also has a fastener 121. The fastener has a head 122 with a wrench engaging portion 124. The fastener head 122 also has a first sealing flange 128 which clamps the hub 60 and seals the hub central opening 68. When fully engaged, the first sealing flange 128 has a clamp force of approximately 50 Kn against a shoulder 130 of the hub to ensure an adequate seal. Extending from the head 122 is a fastener shank 134 that has a threaded portion 136. The fastener shank 134 also has a second sealing flange 138. The fastener shank 134 has a longitudinal axial bore 140. The axial bore 140 intersects with a radial cross bore 142 and fluidly connects the camshaft first passage 30 with the hub first radial passages 80. The radial cross bore 142 intersects a radial side of the fastener shank 134 between the sealing flanges 128 and 138. A Belleville washer 150 provides a sealing interface between the second sealing flange 138 and a shoulder 139 of the hub central opening 68. The Belleville washer 150 divides the hub central opening 68 into a front portion exposed to the hub first radial passages 80 and a rear portion exposed to the hub second radial passages 82. The camshaft longitudinal bore 32 threaded portion 36 and the shank threaded portion 136 seal the fluid in the camshaft first passage 30 from the fluid within the hub central opening 68 which is exposed to the fluid in the camshaft second passage 42.

Referring to FIG. 3, the angular position between the hub 60 and the camshaft pulley assembly 90 will be fixed with respect to one another by a lock-out mechanism 156 and a pin (not shown) which is typical to variable timed camshaft arrangements and not considered part of this invention. Also, in most instances, a torsional spring arrangement (not shown) will be provided to angularly bias the position of the pulley assembly 90 with respect to the hub 60. A VCT spool valve control unit (not shown) will function to control the fluid pressure which communicates via groove openings 54 with the camshaft first fluid passage 30. The spool valve control unit will also control the fluid pressure which communicates with groove openings 56, 58 of the camshaft second fluid passage 42.

In most instances, the camshaft first fluid passage 30 will be connected with the retard phase of operation of the variable timed camshaft arrangement 7. When the lock-out mechanism 156 is not functional and it is desired to modify the timing of the engine valves, pressurized fluid through a journal bearing is communicated through openings 54 into the camshaft first fluid passage 30. The fluid passes through the longitudinal axial bore 140 of fastener shank 134. The pressurized retard fluid then passes through the radial cross bore 142 wherein it communicates with the hub first radial passages 80 and flows to the retard angle space 108 (FIG. 3). Simultaneously, the pressure within the second radial passage 42 is lowered, allowing fluid to flow out of groove opening 56 to the spool valve, and allowing fluid from the advance angle space 112 to be relieved from the pressure chamber 104 flowing radially inward through the second radial passages 82 into the hub central opening enlarged portion 72 and then to exit out the second fluid passage 42. To advance the angular position of the camshaft 10 with respect to the pulley assembly 90, the second fluid passage 42 is pressurized and the camshaft first passage 30 is depressurized by the removal of fluid causing hub 60 to advance with respect to the pulley assembly 90.

Assembly of the pulley assembly 90 and the hub 60 (sometimes referred to as the VCT assembly) to the camshaft 10 is simplified due to the fact that torquing fastener 121 clamps the hub 60 against the camshaft end face 26 and sets the various sealing interfaces of the first sealing flange 128/shoulder 130; second sealing flange 138/Belleville washer 150/shoulder 139; and shank threaded portion 136/camshaft longitudinal bore threaded portion 36. The recess 162 of the hub allows the fastener head 122 to be recessed. The sealing interface 128/130 eliminates a need for a cover over head 122. A plane which is parallel to the main interface between the hub and the camshaft end face 26 passes through the tooth portion 96 of the pulley assembly 90.

Figure 5:
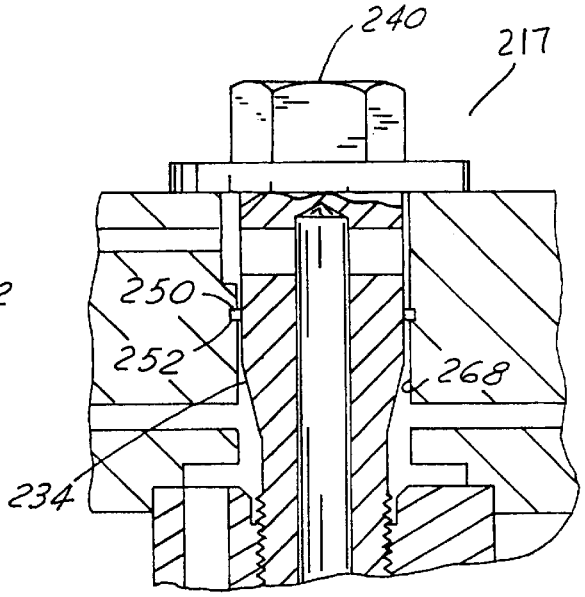
FIG. 5 is a view similar to that of FIG. 1 illustrating an alternative preferred embodiment wherein sealing between a shank of the bolt fastener and a central opening of the hub is achieved by an O-ring.

Turning now FIG. 5, with similar items given similar reference numerals to those shown in FIGS. 1–4, an alternate preferred embodiment arrangement 217 of a vane-type timed camshaft is provided. The arrangement 217 has a fastener 240 with a shank 234 which is radially engaged by an O-ring sealing member 250. The O-ring 250 is positioned within an annular groove 252 provided within the hub central opening 268. Accordingly, the Belleville washer 150 and the second flange 138 of the prior fastener 121 are eliminated.

Vane-type variable timed camshaft arrangements 7 and 217 provide a variable cam timing having a single bolt attachment which is compatible with variable cam timing systems that require two pressurized oil connections. The vane-type camshaft arrangements 7, 217 of the present invention allow for a hub/camshaft clamping interface to the front face of the camshaft on the outermost annular surface so that hold torque is maximized. The clamp interface for the hub/camshaft has a controlled contact area so that the contact pressure is at an optimum level. The sealing of the fastener eliminates the requirement for a cover to seal the oil chambers within the hub. Finally, both arrangements 7, 217 allow for a simplified camshaft design. Since the retard pressurized fluid flows through the first passage 30 and through the axial bore 140, there does not have to be additional longitudinal bores drilled in the camshaft end face 26 for the retard pressurized fluid like the longitudinal bores 44 and 48 which are provided for advanced pressurized fluid. Accordingly, the journal diameter of the camshaft can be held to a smaller dimension than that which would be required if there were two additional longitudinal bores which would be extending into the camshaft end face to the cross-bore 40.

While preferred embodiments of the present invention have been disclosed, it is to be understood that they have been disclosed by way of example only and that various modifications can be made without departing from the spirit and scope of the invention as it is encompassed by the following claims.

We claim:

1. An arrangement of a dual oil feed variable timed camshaft for an automotive vehicle internal combustion engine comprising:

a camshaft having a radial side and an extreme longitudinal end face, said camshaft having a first passage fluidly connecting said end face with said radial side away from said end face, said first passage including a longitudinal bore with a threaded portion, said camshaft also having a second passage fluidly separated from said first passage connecting said end face with said radial side away from said end face;

a hub with a face for abutting connection with said camshaft end face, said hub having a central opening intersecting with said first and said second passage of said camshaft, said hub having at least first and second radial passages intersecting with said hub central opening axially spaced from one another;

a timing pulley assembly mounted on said hub having relative rotational movement with respect to said hub;

at least one movable pressure boundary connected to one of said timing pulley assembly and said hub, said pulley assembly and said hub defining a pressure chamber which is bifurcated by said movable pressure boundary into a first directional angle space intersecting with said hub first radial passage and a second directional angle space intersecting with said hub second radial passage;

a fastener having a head and a threaded shank extending therefrom, said fastener shank having intersecting longitudinal and radial bores fluidly connecting said camshaft first passage with said hub first radial passage, and said fastener head contacting said hub to fasten said hub with said camshaft; and a sealing member providing an interface between said fastener shank and said hub central opening to separate portions of said hub central opening exposed to said hub first radial passage from portions of said hub central opening exposed to said hub second radial passage.

2. An arrangement of a dual oil feed variable timed camshaft as described in claim 1, wherein said movable pressure boundary is a vane which circumferentially bifurcated said first and second directional angle spaces.

3. An arrangement of a dual oil feed variable timed camshaft as described in claim 1, wherein said camshaft and said hub contact each other about an annular end face of said camshaft adjacent an outer diameter of said camshaft end face.

4. An arrangement of a dual oil feed variable timed camshaft as described in claim 3, wherein said hub has a recessed perpendicular shouldered end face contacting said camshaft end face.

5. An arrangement of a dual oil feed variable timed camshaft as described in claim 1, wherein said camshaft is fabricated from a hollow tubular member with attached cam lobes.

6. An arrangement of a dual oil feed variable timed camshaft as described in claim 1, wherein a plane intersecting a point of contact between said camshaft end face and said hub intersects a tooth portion of said pulley assembly.

7. An arrangement of a dual oil feed variable timed camshaft as described in claim 1, having a plurality of movable pressure boundaries and pressure chambers.

8. An arrangement of a dual oil feed variable timed camshaft as described in claim 1, wherein said hub central opening has a shoulder and said fastener has a sealing flange and said sealing member is axially captured between said sealing flange of said fastener and said shoulder of said hub central opening.

9. An arrangement of a dual oil feed variable timed camshaft as described in claim 8, wherein said sealing member is a Belleville washer.

10. An arrangement of a dual oil feed variable timed camshaft for an automotive vehicle as described in claim 1, wherein said longitudinal bore of said first passage in said camshaft is an axial bore.

11. An arrangement of a dual oil feed variable timed camshaft for an automotive vehicle as described in claim 1, having an annular groove in one of said hub central openings and said fastener shank and wherein a sealing member is disposed in said groove.

12. An arrangement of a dual oil feed variable timed camshaft as described in claim 11, wherein said groove for said sealing member is in said hub central opening.

13. An arrangement of a dual oil feed variable timed camshaft as described in claim 1, wherein said first passage is for retarding said camshaft with respect to said pulley.

14. An arrangement of a dual oil feed variable timed camshaft as described in claim 13, wherein said first passage intersects with said camshaft radial side farther away from said camshaft end face than said second passage intersects with said camshaft radial side.

15. An arrangement of a dual oil feed variable timed camshaft as described in claim 1, wherein said fastener head has a sealing flange portion and wrench engagement portion.

16. An arrangement of a dual oil feed variable timed camshaft as described in claim 1, wherein said threaded portion of said camshaft longitudinal bore and said fastener threaded shank seal said first passage from said hub central opening exposed to said camshaft second passage.

17. An arrangement of a dual oil feed variable timed camshaft as described in claim 1, wherein said fastener has a first flange for contacting said hub and a second flange that seals said hub first passage between portions of said hub first passage exposed to said camshaft first passage and said camshaft second passage.

18. An arrangement of a dual oil feed variable timed camshaft as described in claim 1, wherein said second passage has a second branch connecting said radial side of said camshaft with said end face of said camshaft.

19. An arrangement of a vane-type variable timed camshaft for an automotive vehicle internal combustion engine comprising:

a camshaft having a radial side and an extreme longitudinal end face, said camshaft having a first passage fluidly connecting said end face with said radial side away from said end face, said first passage including an axial longitudinal bore with a threaded portion, said camshaft also having a second longitudinal passage fluidly separated from said first passage connecting said end face with said radial side away from said end face;

a hub with a face for abutting connection with said camshaft end face along an annular interface adjacent an outer diameter of said camshaft, said hub having a multi-diametered, central opening intersecting with said first and said second passage of said camshaft, said hub having a first set of radial passages and a second set of radial passages intersecting with said hub central opening, said first and second radial passages being axially spaced from one another;

a timing pulley assembly mounted on said hub having relative rotational movement with respect to said hub, said pulley assembly having a tooth portion intersected by a plane passing through said camshaft end face;

a plurality of vanes connected on and extending from said hub, said pulley assembly and said hub defining pressure chambers which are bifurcated by one of said vanes into a first directional angle space intersecting with said hub first radial passage and a second directional angle space intersecting with said hub second radial passage;

a fastener having a head with a threaded shank extending therefrom, said fastener head having a wrench engagement portion and a first sealing flange, said fastener shank having intersecting axial and radial bores fluidly connecting said camshaft first passage with said hub first radial passage, and said fastener head contacting said hub to fasten said hub with said camshaft, and said fastener first sealing flange sealing said hub central opening at an extreme end, said fastener shank also having a second sealing flange; and a Belleville washer providing an interface between said fastener second sealing flange and a shoulder of said hub central opening to separate portions of said hub central opening exposed to said hub first radial passage from portions of said hub central opening exposed to said hub second radial passage.

20. A fastener for connecting a hub which mounts a timing pulley assembly on a dual oil feed variable time camshaft, said fastener comprising:

a head having a first sealing flange for clamping said hub with said camshaft;

a shank extending from the head with a threaded portion for a sealing threaded attachment with a threaded bore in said camshaft, said shank having an axial bore, said axial bore being intersected by a radial bore.

21. A fastener as described in claim 20, wherein said hub has a wrench-engaging portion.

22. A fastener as described in claim 20, further including a second sealing flange on said shank.

23. A fastener as described in claim 22, wherein said radial bore intersects a radial side of said shank between said first and second sealing flanges.

* * * * *